United States Patent [19]

Bruce

[11] Patent Number: 4,465,184

[45] Date of Patent: Aug. 14, 1984

[54] CIGARETTE CASE

[76] Inventor: Edward G. Bruce, 15555 Huntington Village La., Huntington Beach, Calif. 92647

[21] Appl. No.: 520,907

[22] Filed: Aug. 8, 1983

[51] Int. Cl.[3] ..... A24F 15/20; A24F 15/12; B65D 85/10

[52] U.S. Cl. ..... 206/261; 206/256; 206/263; 206/268; 206/269; 206/443; 220/339

[58] Field of Search ..... 206/256, 261, 262, 263, 206/265, 268, 269, 443, 214; 220/339, 306

[56] References Cited

U.S. PATENT DOCUMENTS

| | | | |
|---|---|---|---|
| D. 112,952 | 1/1939 | Steiner | 206/261 |
| 1,898,386 | 2/1933 | Ottinger et al. | 206/263 |
| 2,619,092 | 11/1952 | Ayers | 206/256 |
| 3,923,152 | 12/1975 | Minneman | 206/443 |

FOREIGN PATENT DOCUMENTS

| | | | |
|---|---|---|---|
| 1230322 | 9/1960 | France | 206/214 |
| 448880 | 12/1967 | Switzerland | 220/339 |
| 29504 | of 1907 | United Kingdom | 206/256 |
| 4514 | of 1910 | United Kingdom | 206/256 |
| 237490 | 7/1925 | United Kingdom | 206/265 |
| 611672 | 11/1948 | United Kingdom | 206/256 |

*Primary Examiner*—William T. Dixson, Jr.
*Assistant Examiner*—Brenda J. Ehrhardt
*Attorney, Agent, or Firm*—Francis X. LoJacono

[57] ABSTRACT

The present invention is directed to a cigarette case formed as a single structure from a suitable plastic material and having three wall sections hingedly interconnected so as to be folded along the cooperating hinge members defined by an integrally formed web member. The three wall sections provide an elongated rear wall having a plurality of elongated contiguous channels, a lower front wall having matching contiguous channels that form elongated compartments with the channels of the rear wall when in a closed mode. An upper front-wall member for access is formed having aligned matching channels which, when closed, provide a substantially sealed cigarette case. A first latching arrangement is provided between the rear and lower front walls, and a second latching arrangement is provided between the upper and lower front walls.

8 Claims, 12 Drawing Figures

FIG. 1
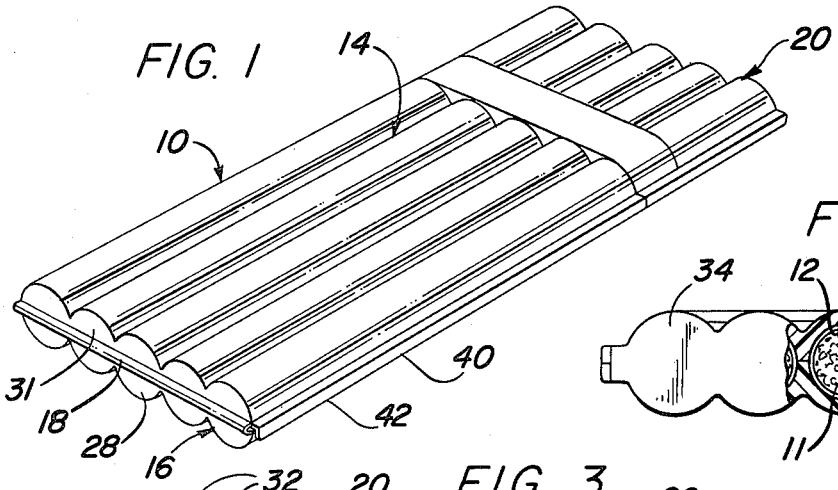
FIG. 2
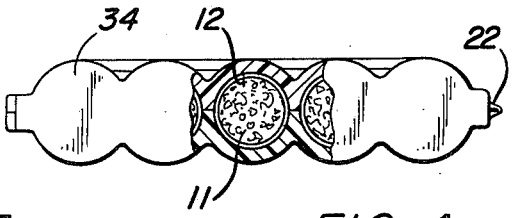
FIG. 3
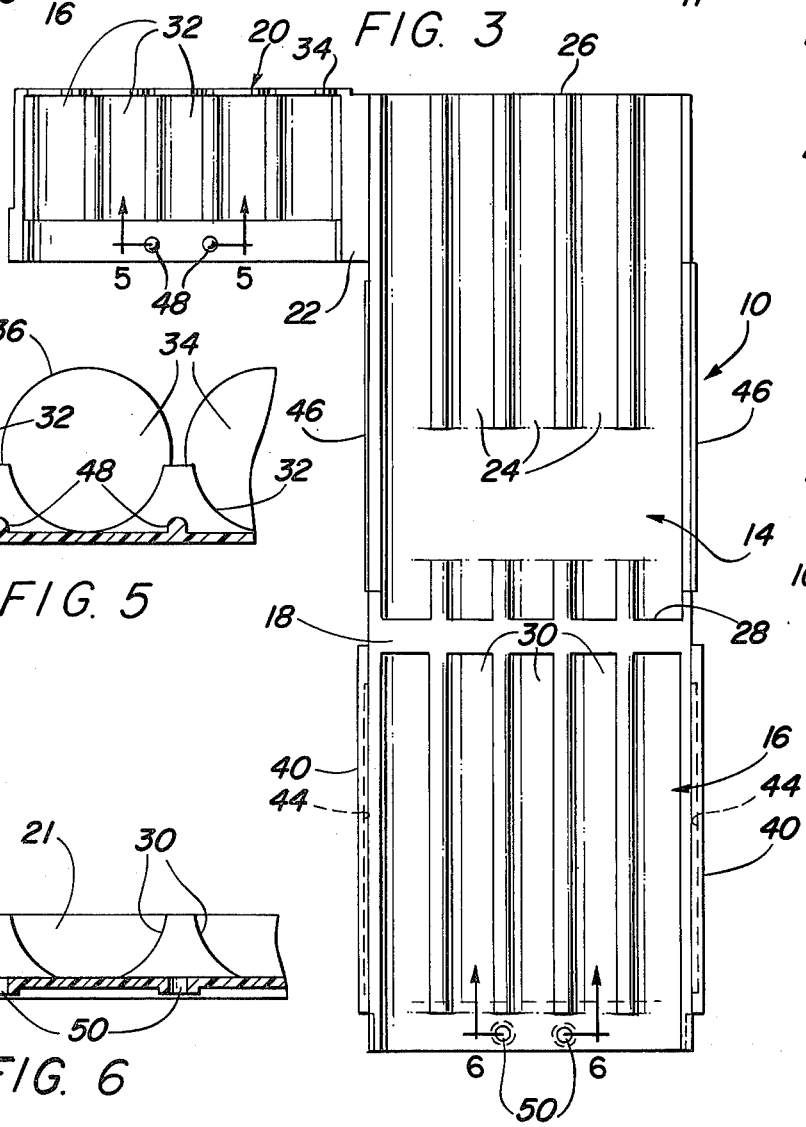
FIG. 4
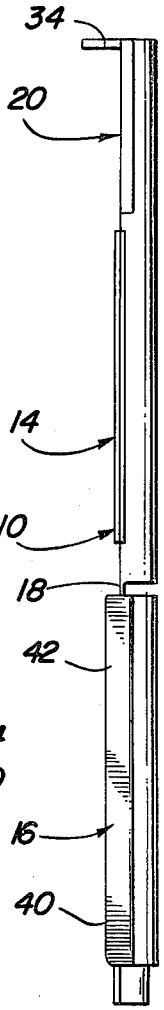
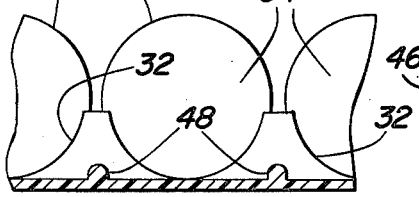
FIG. 5
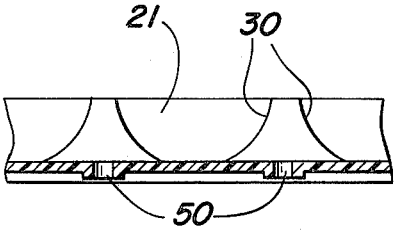
FIG. 6

FIG. 7
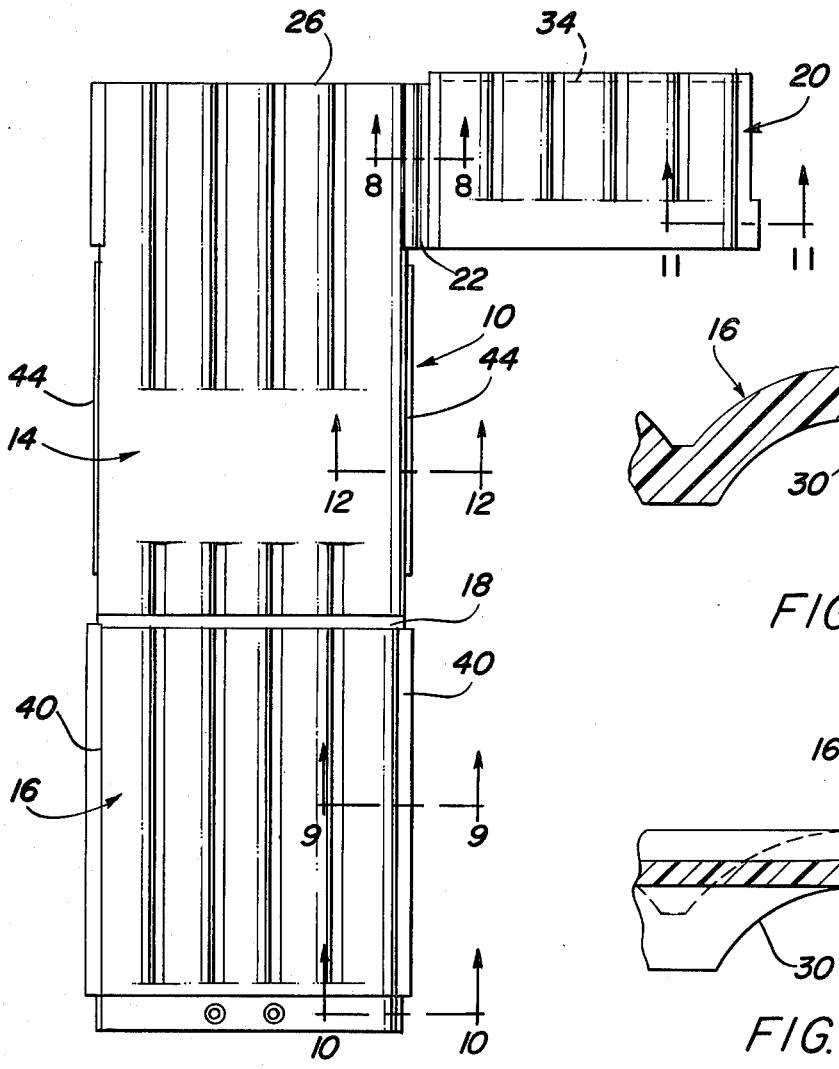
FIG. 8
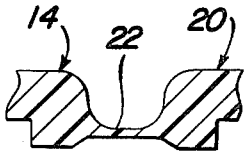
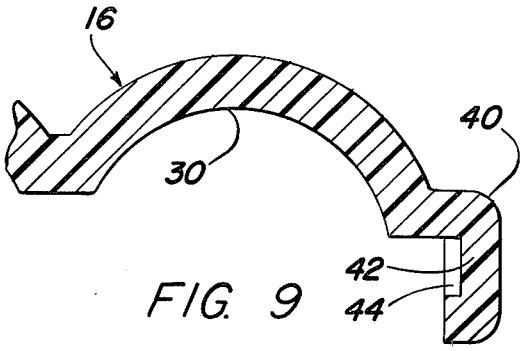
FIG. 9
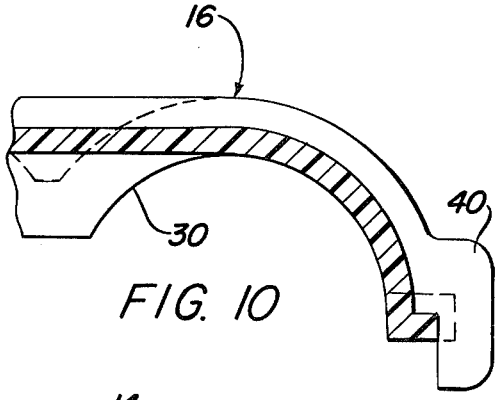
FIG. 10
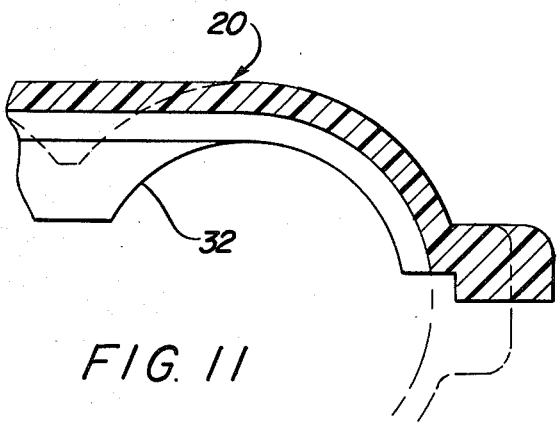
FIG. 11
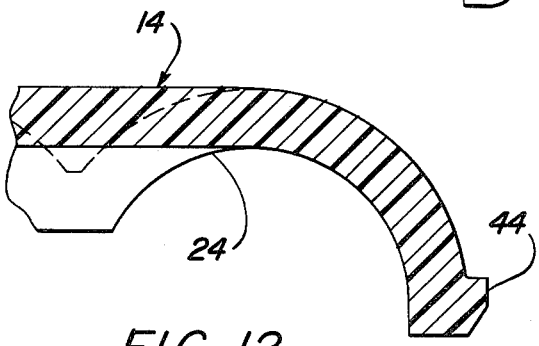
FIG. 12

CIGARETTE CASE

BACKGROUND OF THE INVENTION

Field of the Invention

This invention relates generally to a cigarette storage case, and more particularly to a cigarette case formed from a suitable plastic material which defines a monolithic structure having three foldable wall sections.

It is recognized in the art that there is a need for a cigarette case of the portable type that not only prevents damage to the encased cigarettes, but also provides a suitable structure for storing the cigarettes so that they remain fresh.

There are many known types of arrangements of cigarette cases that have been and are presently being employed for protectively storing cigarettes on the person.

Since cigarette packages are made either from a soft thin paper or from a thicker stiff paper product, they are generally found to be unsatisfactory for carrying in one's pocket or purse because the cigarettes can be easily damaged.

Hence, cigarettes are often transferred from the original packaging to protective carrying cases. However, the known cigarette cases have various features that limit and restrict their use. Very often, these cases are also bulky, complicated and expensive. Thus, the known cigarette cases, while providing a protective storage means, are still not widely used by smokers. Furthermore, the known cases do not provide adequate sealing to retain the freshness of newly bought cigarettes.

SUMMARY OF THE INVENTION

The present invention is directed to a novel, lighweight, easily operated cigarette case formed as a single, unified, plastic structure having three foldable sections which are adapted to be folded in an overlapping sealed manner. One section is defined by a rear base wall having a plurality of longitudinal semicircular channels, the lower end of the rear wall being hingedly connnected to the lower front-wall section which is also provided with a plurality of matching semicircular channels, whereby individual cigarettes are positioned in the respective channels. The third section is defined by an upper front-wall section which is vertically hinged to the rear base wall so that it can be readily opened or closed separately from the lower front-wall section. This allows a cigarette to be easily removed from the case, without the need for opening the lower front-wall section. Thus, the remaining stored cigarettes can not be accidentally dropped or separated from the case, since the combined channels of the rear and lower front sections form elongated wells adapted to receive and hold the individual cigarettes therein. Each wall section is provided with an overlapping, free-latching edge that allows the wall sections to be latched together in a closed mode, and further establishes a sealing means to keep the stored cigarettes in a fresh condition.

Accordingly, it is an important object of the present invention to provide a cigarette case that overcomes many inherent problems with existing cigarette cases.

Still another object of the present invention is to provide a cigarette case that is constructed as a single unit having three foldable sections which form a firm, sealed, storage container when folded.

It is another object of the invention to provide a cigarette case having a monolithic construction defined by an elongated rear wall having a plurality of semicircular channels, the lower edge of the wall being integrally hinged to a lower front-wall section having matching channels, so as to form storage wells for the individual cigarettes. The upper portion of the rear wall also has a top front-wall section integrally hinged to provide access to the enclosed cigarettes without the need for fully opening the front of the case.

It is still another object of the invention to provide a cigarette case of this character that is formed from a suitable plastic material which allows the integrally connected sections to be latched in a closed and sealed manner.

It is a further object of the invention to provide a cigarette case of this character that is easy to operate and maintain, and above all relatively inexpensive to manufacture.

It is still a further object of the invention to provide a cigarette case of this type that is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

Novel features and advantages of the present invention in addition to those mentioned above will become apparent to those skilled in the art from reading the following detailed description in conjunction with the accompanying drawings, which are for illustrative purposes only.

FIG. 1 is a perspective view of the present invention, which is a three sectional cigarette case;

FIG. 2 is an end-elevational view thereof of the end not seen in FIG. 1;

FIG. 3 is a plan view of the cigarette case in an unfolded arrangement, showing the interior surface of the three sections;

FIG. 4 is a left-side-elevational view of FIG. 3;

FIG. 5 is an enlarged cross-sectional view taken substantially along line 5—5 of FIG. 3;

FIG. 6 is an enlarged cross-sectional view taken substantially along line 6—6 of FIG. 3;

FIG. 7 is a plan view of the cigarette case in an unfolded arrangement, showing the exterior surface of the three sections;

FIG. 8 is an enlarged cross-sectional view of the integral hinge section taken along line 8—8 of FIG. 7;

FIG. 9 is an enlarged cross-sectional view of one of the channels and the locking edge thereof taken along line 9—9 of FIG. 7;

FIG. 10 is an enlarged cross-sectional view taken substantially along line 10—10 of FIG. 7;

FIG. 11 is an enlarged cross-sectional view taken along line 11—11 of FIG. 7; and FIG. 12 is an enlarged cross-sectional view taken along line 12—12 of FIG. 7, showing the latching edge formed thereon.

DESCRIPTION OF THE PREFERRED EMBODIMENT

Referring now to the drawings and more particularly to FIG. 1, there is shown in its folded or sealed mode a novel cigarette case, generally designated at 10, containing several cigarettes 11 so as to be stored therein for protection from damage and to retain freshness.

When in the folded arrangement as seen in FIGS. 1 and 2, case 10 will define a plurality of contiguous, elongated, tubular compartments 12 in which cigarettes 11 are individually stored, as shown in the breakaway section of FIG. 2.

It is contemplated that a suitable plastic material be employed in the construction of the case 10, whereby it can be formed as a single unit having three interconnected sections hinged together, as illustrated in FIGS. 3 and 7. Various methods of forming the case can be used such as injection molding and vacuum forming, both being well known in the art.

The first main or base section of the case 14 will also be referred to as the rear-wall member. A second section 16 defines the lower front-wall member which is integrally connected along the lower transverse edge of rear wall 14 by a thin web member 18 which defines a hinge means therebetween. Web 18 allows the lower front-wall member 16 to be bent so as to be superposed over rear-wall member 14, as seen in FIG. 1. The third section 20 defines the upper front-wall member which is integrally attached to the upper portion of rear-wall member 14. Upper front wall 20 is connected by a web member 22 which is positioned along an upper longitudinal edge of the rear-wall member, as shown in FIGS. 3 and 7, whereby a second hinge means is established to allow upper section 20 to fold over the upper portion of the rear wall 14. Thus, when the upper and lower sections 16 and 20 are folded along their web members, the case is formed and is then ready to receive a given number of cigarettes in the juxtaposed compartments 12.

Each respective wall member 14, 16 and 20 is provided with a plurality of elongated channels, all arranged to be oppositely aligned with each other to define the individual tubular compartments 12. That is, rear-wall member 14 is formed having a plurality of elongated channels 24 which extend from its upper open edge 26 to its lower bottom edge 28, the bottom edge 28 defining a bottom wall shaped to correspond to the corrugated form of the rear wall. Thus, the plurality of parallel channels create a corrugated wall structure, whereby the outer surface of wall 14 is formed by the plurality of parallel convexed ridges.

The lower front-wall member 16 is also formed in the same manner with matching aligned channels 30 and an end wall 31. Hence, it can be seen that, when wall 16 is folded over wall 14, compartments 12 will be formed. The upper section or front wall 20 is also provided with a plurality of aligned and matched channels 32, and is further provided with an end wall 34 which is formed having a plurality of semicircular members 36 adapted to match the corrugated outer surface of the case, as seen in FIG. 2.

In order to latch the three sections in a substantially closed and sealed mode for cigarette storage, there are provided various latching means. Thus, to latch the lower front-wall section 16 in a closed and folded relationship with rear-wall section 14, the two oppositely disposed longitudinal edges 40 of wall 16 are formed having a depending flange 42 in which groove 44 is longitudinally disposed, as seen in FIGS. 3 and 44. In order to correspond to grooved flange 42, rear wall 14 is formed having oppositely disposed, elongated, tongue members 46 which are adapted to be received in corresponding grooves 44. Hence, rear wall 14 is readily latched together with the lower front wall 16. Once cigarettes are stored in compartments 12, lower front wall 16 need not be opened for access, since upper front wall 20 provides the needed access to the cigarettes.

Accordingly, the upper front section 20 is also provided with a latching means which allows section 20 to be releasably locked in a closed mode over the upper portion of rear wall 14. The latch means is formed having a pair of projecting lug members positioned on the lower edge of the upper front wall 20, whereby the lugs 48 will engage a matching pair of apertures 50 which are formed in the upper edge of the lower front wall 16. Thus, to pick out a stored cigarette, one merely opens the upper front-wall section 20.

It is contemplated that various sizes of cases will be provided so as to accept corresponding sizes of cigarettes, since the various manufacturers produce different sizes of cigarettes. Also, the length of a cigarette can vary from one brand to another, and thus the length of compartment 12 will be formed to correspond to a particular cigarette size.

The invention and its attendant advantages will be understood from the foregoing description; and it will be apparent that various changes may be made in the form, construction and arrangement of the parts of the invention without departing from the spirit and scope thereof or sacrificing its material advantages, the arrangement hereinbefore described being merely by way of example; and I do not wish to be restricted to the specific form shown or uses mentioned, except as defined in the accompanying claims.

I claim:

1. A cigarette case, comprising:

a single unified structure having three foldable wall sections;

a first rear-wall section formed having a plurality of contiguous channels formed therein to receive cigarettes individually in each channel;

a second lower front-wall section hingedly connected to rear-wall section and having a plurality of contiguous channels formed therein to match said channels of said rear-wall section;

a third upper front-wall section hingedly connected to said rear-wall section adjacent the upper end thereof, so as to overlap a portion of said lower front-wall section, when said case is positioned in a closed and sealed mode, said upper front-wall section having a plurality of contiguous channels formed therein;

a first hinge means between said rear-wall section and said lower front-wall section;

a second hinge means between said rear-wall section and said upper front-wall section;

a first latching means arranged between said rear-wall section and said lower front-wall section; and a second latching means arranged between said upper front-wall section and said lower front-wall section.

2. A cigarette case as recited in claim 1, wherein said channels of said wall define respective tubular compartments to receive individual cigarettes therein for storage when said case is in a closed and sealed mode.

3. A cigarette case as recited in claim 2, wherein said upper front-wall section defines a means for access to said compartments formed by said matching channels of said rear and lower front wall sections.

4. A cigarette case as recited in claim 3, wherein said channels in said wall sections define corrugated wall members having convex-concave surfaces.

5. A cigarette case as recited in claim 3, wherein said first latching means comprises:

a pair of depending, elongated, flange members formed along the opposite longitudinal edges of said lower front-wall section, said flange members being formed having longitudinal grooves; and a pair of extended, elongated, tongue members formed along the opposite longitudinal edges of said rear-wall section and adapted to be latched within said groove of said depending flange member.

6. A cigarette case as recited in claim 5, wherein said second latchimg means comprises:

a pair of outwardly projecting lug members formed on said upper front-wall section; and a pair of apertures formed in said lower front-wall section, said apertures and said lug members being arranged to engage each other when said case is in a closed and sealed mode.

7. A cigarette case as recited in claim 6, wherein said first hinge means comprises an integrally formed web member disposed between said rear-wall section and said lower front-wall section, and wherein said second hinge means comprises an integrally formed web member disposed between said rear-wall section and said upper front-wall section.

8. A cigarette case as recited in claim 7, wherein said web member of said first hinge means is transversely disposed along the lower edge of said rear-wall section, and wherein said web member of said second hinge means is longitudinally disposed along the upper portion of said rear-wall section.

* * * * *